US007208257B2

(12) United States Patent
Cheng et al.

(10) Patent No.: US 7,208,257 B2
(45) Date of Patent: Apr. 24, 2007

(54) ELECTRON BEAM CURABLE TONERS AND PROCESSES THEREOF

(75) Inventors: Chieh-Min Cheng, Rohester, NY (US); Tie Hwee Ng, Mississauga (CA)

(73) Assignee: Xerox Corporation, Stamford, CT (US)

( * ) Notice: Subject to any disclaimer, the term of this patent is extended or adjusted under 35 U.S.C. 154(b) by 335 days.

(21) Appl. No.: 10/875,243

(22) Filed: Jun. 25, 2004

(65) Prior Publication Data

US 2005/0287464 A1 Dec. 29, 2005

(51) Int. Cl.
*G03G 15/20* (2006.01)

(52) U.S. Cl. ..... 430/124; 399/320

(58) Field of Classification Search ..... 430/124, 430/120; 399/320

See application file for complete search history.

(56) References Cited

U.S. PATENT DOCUMENTS 2,618,551 A 11/1952 Walkup
2,618,552 A 11/1952 Wise
2,725,305 A 11/1955 Allen et al.
2,791,949 A 5/1957 Simmons et al.
2,918,910 A 12/1959 Fink
3,015,305 A 1/1962 Hall et al.
3,590,000 A 6/1971 Palermiti et al.
3,944,493 A 3/1976 Jadwin et al.
4,007,293 A 2/1977 Mincer et al.
4,079,014 A 3/1978 Burness et al.
4,298,672 A 11/1981 Lu
4,394,430 A 7/1983 Jadwin et al.
4,464,452 A 8/1984 Gruber et al.
4,480,021 A 10/1984 Lu et al.
4,558,108 A 12/1985 Alexandro et al.
4,560,635 A 12/1985 Hoffend et al.
4,656,112 A 4/1987 Kawagishi et al.
4,788,123 A 11/1988 Berkes et al.
4,828,956 A 5/1989 Creatura et al.
4,894,308 A 1/1990 Mahabadi et al.
4,937,157 A 6/1990 Haack et al.
4,948,686 A 8/1990 Koch et al.
4,963,455 A 10/1990 Laing et al.
4,965,158 A 10/1990 Gruber et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,376,172 A 12/1994 Tripp et al.
5,403,693 A 4/1995 Patel et al.
5,405,728 A 4/1995 Hopper et al.
5,418,108 A 5/1995 Kmiecik-Lawrynowicz et al.
5,482,812 A 1/1996 Hopper et al.
5,496,676 A 3/1996 Croucher et al.
5,501,935 A 3/1996 Patel et al.
5,527,658 A 6/1996 Hopper et al.
5,585,215 A 12/1996 Ong et al.
5,593,807 A 1/1997 Sacripante et al.
5,604,076 A 2/1997 Patel et al.
5,622,806 A 4/1997 Veregin et al.
5,648,193 A 7/1997 Patel et al.
5,650,255 A 7/1997 Ng et al.
5,650,256 A 7/1997 Veregin et al.
5,658,704 A 8/1997 Patel et al.
5,660,965 A 8/1997 Mychajlowskij et al.
5,723,253 A 3/1998 Higashimo et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,888,689 A * 3/1999 De Meutter et al. ..... 430/124
5,902,710 A 5/1999 Ong et al.
5,910,387 A 6/1999 Mychajilowskij et al.
5,916,725 A 6/1999 Patel et al.
5,919,595 A 7/1999 Mychajilowskij et al.
5,922,501 A 7/1999 Cheng et al.
5,925,488 A 7/1999 Patel et al.
5,945,245 A 8/1999 Mychajilowskij et al.
5,977,210 A 11/1999 Patel et al.
6,017,671 A 1/2000 Sacripante et al.
6,020,101 A 2/2000 Sacripante et al.
6,045,240 A 4/2000 Hochstein
6,063,827 A 5/2000 Sacripante et al.

(Continued)

*Primary Examiner*—John L Goodrow
(74) *Attorney, Agent, or Firm*—MH2 Technology Law Group

(57) ABSTRACT

A process having a step of radiating toner with electron beam radiation, wherein the radiation results in curing the toner is disclosed. A toner curing process is disclosed wherein toner is radiated, wherein the toner comprises at least one resin and at least one colorant, and wherein the toner is generated by an emulsion aggregation coalescence method. A method for crosslinking toner particles is disclosed wherein toner particles formed by an emulsion aggregation process are radiated with electron beam radiation, and wherein the toner particles contain at least one resin with crosslinkable functional groups.

19 Claims, No Drawings

U.S. PATENT DOCUMENTS 6,132,924 A 10/2000 Patel et al.
6,139,674 A 10/2000 Markham et al.
6,143,457 A 11/2000 Carlini et al.
6,210,853 B1 4/2001 Patel et al.
6,302,513 B1 10/2001 Moffat et al.
6,358,655 B1 3/2002 Foucher et al.
6,383,706 B1 5/2002 Kumar et al.
6,439,711 B1 8/2002 Carlini et al.
6,467,871 B1 10/2002 Moffat et al.
6,521,297 B2 2/2003 McDougall et al.
6,652,959 B2 11/2003 Foucher et al.
6,673,501 B1 1/2004 Combes et al.
7,070,896 B2 * 7/2006 Kishimoto et al. ..... 430/108.2
2002/0086161 A1 * 7/2002 Smetana et al. ..... 428/413
2005/0250039 A1 * 11/2005 Halfyard et al. ..... 430/124

* cited by examiner

ELECTRON BEAM CURABLE TONERS AND PROCESSES THEREOF

FIELD

The present invention relates to electron beam curable toner compositions and processes for making and using thereof. The toner compositions disclosed herein may be selected for use in graphic arts and packaging applications, such as, temperature sensitive packaging and foil seals.

INTRODUCTION

A current trend in the printing industry is xerographic packaging applications. Such applications generally utilize heat fused toners. However, there are a number of problems associated with using heat fused toners in these applications. One problem relates to fusing toners on rough or thick substrates, such as cardboard stock. Moreover, it is difficult to transfer the heat of a heat-roll fuser system through heavy and textured papers, much less the very high area coverage of color print jobs.

Additionally, printing for a number of packaging applications can require the use of materials that are durable and which are resistant to a variety of conditions and environmental factors. Conventional package printing uses curable inks, such as ultraviolet or thermal curable inks, to "toughen" the resulting printed image or indicia such that the image or indicia on the final packaging is durable and wear-resistant. In addition, many offset printings use a heated overcoat to protect the image from abrasion. However, overcoats applied to fused and unfused images can cause degradation of image quality. Accordingly, there is a need for a toner composition that in embodiments may not require a protective overcoat.

The U.S. Government has been irradiating mail with electron beam irradiation to sterilize the mail against possible anthrax, bacteria, or virus contamination. The mail is generally irradiated with a does that may exceed a 10 kGy level. In addition, if mail were to be irradiated from both sides, this dose would be doubled. These very high doses are needed to obtain the sought after "kill ratio" which is in the order of 12–14 decades (in other words, the fraction of surviving spores is intended to be only in the order of $10^{-11}$ to $10^{-13}$). Ultimately, the deposited energy is converted to thermal energy, causing a rise in temperature of the irradiated material.

U.S. Pat. No. 6,673,501, the disclosure of which is entirely incorporated herein by reference, discloses a toner composition comprising particles of a polyester resin, an optional colorant, and polypyrrole, wherein the toner particles are prepared by an emulsion aggregation process. Also disclosed is a process comprising (a) generating an electrostatic latent image on an imaging member, and (b) developing the latent image by contacting the imaging member with charged toner particles comprising a polyester resin, an optional colorant, and polypyrrole, wherein the toner particles are prepared by an emulsion aggregation process.

U.S. Pat. No. 6,652,959, the disclosure of which is entirely incorporated herein by reference, discloses marking particles comprising a resin, a chelating agent, and a spiropyran material, wherein the marking particles are prepared by an emulsion aggregation process.

U.S. Pat. No. 6,521,297, the disclosure of which is entirely incorporated herein by reference, discloses a marking material comprising (a) toner particles which comprise a resin and a colorant, wherein the toner particles are prepared by an emulsion aggregation process, and (b) hydrophobic conductive metal oxide particles situated on the toner particles.

U.S. Pat. No. 6,467,871, the disclosure of which is entirely incorporated herein by reference, discloses a process for depositing marking materials onto a substrate, wherein the marking materials comprise toner particles comprising a vinyl resin, an optional colorant, and poly(3,4-ethylenedioxypyrrole), and wherein the toner particles are prepared by an emulsion aggregation process.

U.S. Pat. No. 6,439,711, the disclosure of which is entirely incorporated herein by reference, discloses a process for depositing marking materials onto a substrate, wherein the marking materials comprise toner particles comprising a polyester resin, an optional colorant, and poly(3,4-ethylenedioxythiopene), and wherein the toner particles are prepared by an emulsion aggregation process.

U.S. Pat. No. 6,383,706, the disclosure of which is entirely incorporated herein by reference, discloses an apparatus for grinding toner particles comprising a resin component and a magnetic pigment.

U.S. Pat. No. 6,358,655, the disclosure of which is entirely incorporated herein by reference, discloses marking particles comprising a resin, a chelating agent, and a spiropyran material, wherein the marking particles are prepared by an emulsion aggregation process.

U.S. Pat. No. 6,302,513, the disclosure of which is entirely incorporated herein by reference, discloses a process for depositing marking material onto a substrate. The marking material includes particles including a resin and a colorant, wherein the particles are prepared by an emulsion aggregation process.

Conventional toner compositions and processes are suitable for their intended purposes, a need remains for improved marking processes. There is a need for fused images that may exhibit at least one of adhesion to the substrate, flexibility, and protective properties. A need remains for a fused image that can be cured so that the resulting image is free of abrasion and smearing. A need also remains for a toner composition, wherein no additional chemicals or chemical synthesis steps are needed to create a crosslinked fused image.

SUMMARY

According to aspects of the invention, a process comprises radiating toner with electron beam radiation, wherein the radiation results in curing the toner.

According to another aspects of the invention, a toner curing process comprises radiating the toner, wherein the toner comprises at least one resin and at least one colorant, and wherein the toner is generated by an emulsion aggregation coalescence method.

According to further aspects of the invention, a method for crosslinking toner particles comprises radiating toner particles formed by an emulsion aggregation process with electron beam radiation, wherein the toner particles comprise at least one resin with crosslinkable functional groups.

It is to be understood that both the foregoing general description and the following description of various embodiments are exemplary and explanatory only and are not restrictive.

DESCRIPTION OF VARIOUS EMBODIMENTS

Toner compositions of the disclosed invention may comprise at least one resin, at least one colorant, and may optionally contain additional additives. The disclosed toner compositions may be prepared by an emulsion aggregation process. Moreover, the disclosed toner compositions may be curable upon exposure to electron beam radiation. The disclosed toner compositions are crosslinkable via the electron beam radiation. Electron beam curing of the resulting toner composition may then be utilized to create very durable and wear resistant images for packaging and other applications.

The toner compositions of the disclosed invention may comprise at least one resin. The at least one resin may comprise at least one vinyl monomer and at least one electron beam curable polymer. The at least one vinyl monomer may be selected from the group consisting of styrene and substituted styrenes, 1,3-dienes, substituted 1,3-dienes, acrylates, methacrylates, acrylonitrile, acrylic acid, and methacrylic acid.

The at least one electron beam curable polymer may be prepared by an emulsion polymerization of an acrylic acid, a dimer, an oligomer, or mixtures thereof. The at least one electron beam curable polymer may be present in the at least one resin in an amount ranging from about 10% to about 100%, and for example, from about 20% to about 40%, by weight with respect to the total weight of the resin, although the amounts may be outside of these ranges.

For example, a mixture of acrylic acid, dimer, and oligomer of 2-carboxyethyl acrylate may be available from Polysciences, Inc; for example, Sipomer β-CEA™ is available from Rhone-Poulenc; and as a further example, BETA-C is available from Bimax Chemicals.

The acrylic acid is present in an amount of from about 2% to about 25%, and for example from about 2% to about 15% weight relative to the total weight in the mixture. The dimer may be, for example, present in an amount of from about 5% to about 60%, and as a further example from about 10% to about 40% weight relative to the total weight in the mixture. The oligomer may be present in an amount of from about 30% to about 90%, and as an example from about 50% to about 80% weight relative to the total weight in the mixture.

The dimers and oligomers can be considered alkenoic acids, and more specifically, olefinically unsaturated carboxy functional monomers such as alpha, beta-ethylenically unsaturated carboxylic acids, for example of the formula

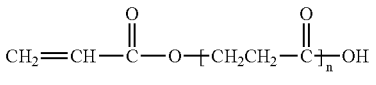

wherein n is a number of from about 1 to about 20, for example from about 1 to about 13, and as a further example from about 1 to about 5; and wherein the number average value of n is 1 or greater. The acid molecule wherein n equals 1 is diacrylic acid or β-acryloxypropionic acid of the formula

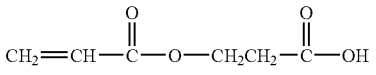

and which acid preferably possesses a molecular weight of about 144 g/mole when n is equal to 1.

These acids can be prepared by the Michael addition reaction of acrylic acid to itself, the degree of addition determining the value of n. For example, 2-carboxyethyl acrylate contains about 20 to 30% tetramer and higher oligomers (n≧3) and these longer pendant acid groups undergo Michaels additions to form hydroxypropionic or higher hydroxy acids upon electron beam radiation. Subsequently, esterification can be carried out by reaction of the hydroxypropionic or higher hydroxy acids with the carboxyethyl group to produce a crosslinked network.

The oligomer acrylic acid preferably possesses an n value of from about 2 to about 20, and preferably from about 2 to about 13, and more preferably from about 2 to about 5. The $M_w$ thereof of the oligomer acrylic acid may be, for example, from about 200 to about 3,500, for example from about 200 to about 2,500. The $M_n$ thereof may be from about 200 to about 1,500, and for example from about 200 to about 1,000.

The at least one resin of the disclosed toner compositions can be selected from polyesters generated from a monomer addition process comprising first alkoxylating a dihydroxy containing monomer, such as a dihydroxy alkane or dihydroxy arylene with a cyclic alkylene carbonate in the presence of a catalyst, such as an alkali carbonate, optionally followed by the addition of a further amount of cyclic alkylene carbonate in the presence of a second catalyst, such as an alkali alkoxide, and followed by a subsequent addition of a diacid, such as a saturated or unsaturated aliphatic diacid or aromatic diacid, to enable the formation of a saturated or unsaturated polyester resin, as described in U.S. Pat. No. 6,063,827, the disclosure of which is totally incorporated herein by reference.

The at least one resin of the disclosed toner compositions can be selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes as disclosed in U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof; and extruded polyesters as disclosed in U.S. Pat. No. 6,139,674, the disclosure of which is totally incorporated.

The at least one resin of the disclosed toner compositions can be selected the esterification products of a dicarboxylic acid and a diol comprising a diphenol. These resins are illustrated in U.S. Pat. No. 3,590,000, the disclosure of which is totally incorporated herein by reference. A toner wherein the resin is the magnesium salt of copoly[(1,2-propylene-dipropylene-5-sulfoisophthalate)-(1,2-propylene-dipropylene terephthalate)-(β-carboxyethyl acrylate)], the magnesium salt of copoly[(1,2-propylene-diethylene-5-sulfoisophthalate)-(1,2-propylene-diethylene terephthalate)-(β-carboxyethyl acrylate)], the calcium salt of copoly[(1,2-propylene-dipropylene-5-sulfoisophthalate)-(1,2-propylene-dipropylene terephthalate)-(β-carboxyethyl acrylate)], the calcium salt of copoly[(1,2-propylene-diethylene-5-sulfoisophthalate)-(1,2-propylene-diethylene terephthalate)-(β-carboxyethyl acrylate)], terephthalate)-(β-carboxyethyl acrylate)]; the barium salt of copoly[(1,2-propylene-dipropylene-5-sulfoisophthalate)-(1,2-propylene-dipropylene terephthalate)-(β-carboxyethyl acrylate)]; the zinc salt of copoly[(1,2-propylene-diethylene-5-sulfoisophthalate)-(1,2-propylene-diethylene terephthalate)-(β-carboxyethyl acrylate)], the zinc salt of copoly(1,2-propyl-dipropylene-5-sulfoisophthalate)-(1,2-propylene-di propylene terephthalate)-(β-carboxyethyl acrylate)], the vanadium salt of copoly[(1,2-propylene-dipropylene-5-sulfoisophthalate)-(1,2-propylene-dipropylene terephthalate)-(β-carboxyethyl acrylate)]; the vanadium salt of copoly[(1,2-propylene-diethylene-5-sulfoisophthalate)-(1,2-propylene-diethylene terephthalate)-(β-carboxyethyl acrylate)]; the copper salt of copoly[(1,2-propylene-dipropylene-5-sulfoisophthalate)-(1,2-propylene-dipropylene terephthalate)-(β-carboxyethyl acrylate)]; and the copper salt of copoly(1,2-propylene-diethylene-5-sulfoisophthalate)-(1,2-propylene-diethylene terephthalate)-(β-carboxyethyl acrylate)]. The weight average molecular weight of the polyester may be from about 2,000 grams per mole to about 100,000 grams per mole and the number average molecular weight may be from about 1,000 grams per mole to about 50,000 grams per mole, although the relative amounts can be outside of these ranges. The polydispersity thereof may be from about 2 to about 18 as measured by gel permeation chromatography.

The disclosed toner composition may comprise at least one resin comprising styrene, butyl acrylate, and 2-carboxyethyl acrylate. The crosslinkable functional groups in the at least one resin eliminate the need to add additional chemicals or synthesis process steps in order to crosslink the resin.

The at least one resin may be selected from the group consisting of poly(styrene-butadiene-β-carboxyethyl acrylate), poly(methylstyrene-butadiene-β-carboxyethyl acrylate), poly(methyl methacrylate-β-carboxyethyl acrylate), poly(ethyl methacrylate-butadiene-β-carboxyethyl acrylate), poly(propyl methacrylate-butadiene-β-carboxyethyl acrylate), poly(butyl methacrylate-butadiene-β-carboxyethyl acrylate), poly(methyl acrylate-butadiene-β-carboxyethyl acrylate), poly(ethyl acrylate-β-carboxyethyl acrylate), poly(propyl acrylate-butadiene-β-carboxyethyl acrylate), poly(styrene-isoprene-β-carboxyethyl acrylate), poly(methylstyrene-isoprene-β-carboxyethyl acrylate), poly(methyl methacrylate-isoprene-β-carboxyethyl acrylate), poly(ethyl methacrylate-isoprene-β-carboxyethyl acrylate), poly(propyl methacrylate-isoprene-β-carboxyethyl acrylate), poly (butyl methacrylate-isoprene-β-carboxyethyl acrylate), poly (methyl acrylate-isoprene-β-carboxyethyl acrylate), poly (ethyl acrylate-isoprene-β-carboxyethyl acrylate), poly (propyl acrylate-isoprene-β-carboxyethyl acrylate), poly (styrene-propyl acrylate-β-carboxyethyl acrylate), poly (styrene-butyl acrylate-β-carboxyethyl acrylate), and poly (styrene-butyl acrylate-acrylonitrile-β-carboxyethyl acrylate).

The toner compositions may optionally comprise at least one colorant. Examples of the at least one colorant include, but are not limited to, dyes and pigments, such as those disclosed in U.S. Pat. Nos. 4,788,123; 4,828,956; 4,894,308; 4,948,686; 4,963,455; and 4,965,158, the disclosures of all of which are hereby incorporated by reference. Examples of dyes and pigments include carbon black (for example, REGAL 3300®), nigrosine dye, aniline blue, magnetites, phthalocyanines, 2,9-dimethyl-substituted quinacridone and anthraquinone dyes identified in the Color Index as CI 60710, CI Dispersed Red 15, diazo dyes identified in the Color Index as CI26050, CI solvent Red 19, copper tetra (octadecyl sulfonamide) phthalocyanine, x-copper phthalocyanine pigment listed in the Color Index as CI 74160, Pigment Blue, Anthradanthrene Blue identified in the Color Index as CI 69810, Special Blue X-2137, diarylide yellow 3,3-dichlorobenzidene acetoacetanilides, a monoazo pigment identified in the Color Index as CI 12700, CI solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK® and cyan components, and the like, as well as mixtures thereof. Other commercial sources of pigments available as aqueous pigment dispersion from either Sun Chemical or Ciba include, but are not limited to, Pigment Yellow 17, Pigment Yellow 14, Pigment Yellow 93, Pigment Yellow 74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Other suitable colorants include, but are not limited to, Normandy Magenta RD-2400, Permanent Yellow YE 0305, Permanent Violet VT2645, Argyle Green XP-111-S, Lithol Rubine Toner, Royal Brilliant Red RD-8192, Brilliant Green Toner GR 0991, and Ortho Orange OR 2673, all available from Paul Uhlich; Sudan Orange G, Tolidine Red, and E.D. Toluidine Red, available from Aldrich; Sudan III, Sudan II, and Sudan IV, all available from Matheson, Coleman, Bell; Scarlet for Thermoplast NSD PS PA available from Ugine Kuhlman of Canada; Bon Red C available from Dominion Color Co.; Lumogen Yellow D0790, Suco-Gelb L1250, Suco-Yellow D1355, Paliogen Violet 5100, Paliogen Orange 3040, Paliogen Yellow 152, Paliogen Red 3871 K, Paliogen Red 3340, Paliogen Yellow 1560, Paliogen Violet 5890, Paliogen Blue 6470, Lithol Scarlet 4440, Lithol Fast Scarlet L4300, Lithol Scarlet D3700, Lithol Fast Yellow 0991K, Paliotol Yellow 1840, Heliogen Green L8730, Heliogen Blue L6900, L7202, D6840, D7080, Sudan Blue OS, Sudan Orange 220, and Fanal Pink D4830, all available from BASF; Cinquasia Magenta available from DuPont; Novoperm Yellow FG1 available from Hoechst; Hostaperm Pink E, and PV Fast Blue B2G01 all available from American Hoechst; Irgalite Blue BCA, and Oracet Pink RF, all available from Ciba-Geigy. Mixtures of colorants can also be employed. When present, the optional at least one colorant, may be present in the toner composition in any desired or effective amount, such as from about 1% to about 25% by weight of the toner particles, for example at least about 2% to about 15%. Although the amount can be outside of these ranges.

The toner particles optionally can also comprise at least one charge control additive, such as alkyl pyridinium halides, including cetyl pyridinium chloride and others as disclosed in U.S. Pat. No. 4,298,672, the disclosure of which is hereby incorporated by reference, sulfates and bisulfates, including distearyl dimethyl ammonium methyl sulfate as disclosed in U.S. Pat. No. 4,560,635, the disclosure of which is hereby incorporated by reference, and distearyl dimethyl ammonium bisulfate as disclosed in U.S. Pat. Nos. 4,937,157; 4,560,635, and copending application Ser. No. 07/396,497, abandoned, the disclosures of all of which are hereby incorporated by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated by reference, aluminum 3,5-di-tert-butyl salicylate compounds such as Bontron E-88, available from Orient Chemical Company of Japan, or aluminum compounds as disclosed in U.S. Pat. No. 4,845,003, the disclosure of which is hereby incorporated by reference, charge control additives as disclosed in U.S. Pat. Nos. 3,944,493; 4,007,293; 4,079,014; 4,394,430; 4,464,452; 4,480,021; and 4,560,635, the disclosures of all of which are hereby incorporated by reference, and the like, as well as mixtures thereof. The optional at least one charge control additive may be present in the toner composition in an amount ranging from about 0.1% to about 5% by weight of the toner particles. Although the amount can be outside this range.

The toner composition may also optionally comprise at least one external surface additive, such as, for example, metal salts, metal salts of fatty acids, colloidal silicas, and the like, as well as mixtures thereof. The optional at least one external surface additive may be present in any desired or effective amount, for example, ranging from about 0.1% to about 2% by weight with respect to the toner particles. Although the amount can be outside this range. Examples of the at least one external surface additive include, but are not limited to, zinc stearate and AEROSIL R812® silica as flow aids, available from Degussa. The external additive can be added during the aggregation process or blended onto the formed particles.

The toner particles of the disclosed invention may be prepared by an emulsion aggregation process. The emulsion aggregation process generally entails (a) preparing a latex emulsion comprising resin particles, (b) combining the latex emulsion with optionally at least one colorant, (c) heating the latex emulsion containing the resin to a temperature below the glass transition temperature of the resin, and (d) after heating the latex emulsion containing the resin to a temperature below the glass transition temperature of the resin, heating the latex emulsion containing the resin to a temperature above the glass transition temperature of the resin. In an embodiment, the emulsion aggregation process entails (a) preparing a dispersion of at least one optional colorant, (b) admixing the dispersion with a latex emulsion comprising resin particles and an optional at least one flocculating agent, thereby causing flocculation or heterocoagulation of formed particles of colorant and resin to form electrostatically bound aggregates, (c) heating the electrostatically bound aggregates at a temperature below the glass transition temperature ($T_g$) of the resin to form stable aggregates, and (d) heating the stable aggregates at a temperature above the glass transition temperature ($T_g$) of the resin to coalesce the stable aggregates into toner particles.

In another embodiment, the emulsion aggregation process entails (a) preparing a dispersion in a solvent, such as water, the dispersion comprising at least one ionic surfactant, at least one colorant, and at least one optional charge control agent; (b) shearing the dispersion with a latex emulsion comprising (i) at least one surfactant which is either (1) counterionic, with a charge polarity of opposite sign to that of the at least one ionic surfactant, or (2) nonioinic, and (ii) at least one resin, thereby causing flocculation or heterocoagulation of formed particles of at least one colorant, resin, and at least one optional charge control agent to form electrostatically bound aggregates; (c) heating the electrostatically bound aggregates at a temperature below the glass transition temperature of the resin to form stable aggregates (the aggregates have an average particle diameter ranging from about 1 micron to about 25 microns, for example, from about 2 microns to about 10 microns, although the particle size can be outside of this range; the stable aggregates typically have a relatively narrow particle size distribution of GSD=about 1.16 to about GSD=1.25, although the particle size distribution can be outside of this range), and (d) adding an additional amount of the at least one ionic surfactant to the aggregates to stabilize them further, prevent further growth, and prevent loss of desired narrow particle size distribution, and heating the aggregates to a temperature above the resin glass transition temperature to provide coalesced toner particles comprising resin, colorant, and optional charge control agent.

Heating can be at a temperature ranging from about 5° C. to about 50° C. above the resin glass transition temperature, although the temperature can be outside this range, to coalesce the electrostatically bound aggregates.

The coalesced particles differ from the uncoalesced aggregates primarily in morphology; the uncoalesced particles have greater surface area, such as having a "grape cluster" shape, whereas the coalesced particles are reduced in surface area, such as having a "potato" shape or even a spherical shape. The particle morphology can be controlled by adjusting conditions during the coalescing process, such as temperature, coalescence time, and the like. Subsequently, the toner particles are washed to remove excess water soluble surfactant or surface absorbed surfactant, and are then dried to produce toner particles.

Another embodiment of the emulsion aggregation process entails using a flocculating or coagulating agent such as poly(aluminum chloride) or poly(aluminum sulfosilicate) instead of a counterionic surfactant of opposite polarity to the at least one ionic surfactant in the latex formation. In this process, the aggregation of submicron latex and colorant and the other optional additives is controlled by the amount of coagulant added, followed by the temperature to which the resultant blend is heated. For example, the closer the temperature is to the Tg of the resin, the bigger the particle size. This process entails (1) preparing a dispersion comprising at least one ionic surfactant; (2) shearing the dispersion with a latex emulsion comprising (a) at least one flocculating agent, (b) at least one nonionic surfactant, and (c) at least one resin, thereby causing flocculation or heterocoagulation of formed particles of the at least flocculating agent and the at least one resin to form electrostatically bound aggregates; and (3) heating the electrostatically bound aggregates to form stable aggregates. The aggregates obtained are generally particles in the range of from about 1 to about 25 microns in average particle diameter, and for example, from about 2 to about 10 microns, although the particle size can be outside of these ranges, with relatively narrow particle size distribution.

To the aggregation is added an alkali metal base, such as an aqueous sodium hydroxide solution, to raise the pH of the aggregates from a pH value which is in the range of from about 2.0 to about 3.0 to a pH value in the range of from about 7.0 to about 9.0, and during the coalescence step, the solution can, if desired, be adjusted to a more acidic pH to adjust the particle morphology. The coagulating agent is added in an acidic solution (for example, a 1 molar nitric acid solution) to the mixture of ionic latex and dispersion, and during this addition step the viscosity of the mixture increases. Thereafter, heat and stirring are applied to induce aggregation and formation of micron-sized particles. When the desired particle size is achieved, this size can be frozen by increasing the pH of the mixture, for example from about 7 to about 9, although the pH can be outside of this range. Thereafter the temperature of the mixture can be increased to the desired coalescence temperature, for example from about 80° C. to about 95° C., although the temperature can be outside of this range. Subsequently, the particle morphology can be adjusted by dropping the pH of the mixture, for example, to values of from about 3.5 to about 5.5, although the pH can be outside of this range.

Examples of the at least one ionic surfactant include, but are not limited to, anionic surfactants, such as sodium dodecylsulfate, sodium dodecylbenzene sulfonate, sodium dodecylnaphthalenesulfate, dialkyl benzenealkyl sulfates and sulfonates, abitic acid, NEOGEN R®, and NEOGEN SC® available from Kao, DOWFAX® available from Dow Chemical Co., and the like, as well as mixtures thereof. Anionic surfactants can be employed in any desired or effective amount, such as from about 0.01% to about 10% by weight of monomers used to prepare the copolymer resin, for example from about 0.1% to about 5%, although the amount can be outside of these ranges.

Further examples of the at least one ionic surfactant include, but are not limited to, cationic surfactants, such as dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$ trimethyl ammonium bromide, $C_{15}$ trimethyl ammonium bromide, $C_{17}$ trimethyl ammonium bromide, halide salts of quaternized polyoxyethylalkylamines, dodecylbenzyl triethyl ammonium chloride, MIRAPOL® and ALKAQUAT® (available from Aklaril Chemical Company), SANIZOL® (benzalkonium chloride, available from Kao Chemicals), and the like, as well as mixtures thereof. Cationic surfactants can be employed in any desired or effective amounts, for example, from about 0.1% to about 5% by weight of water, although the amount can be outside of this range. The molar ratio of the cationic surfactant used for flocculation to the anionic surfactant used in latex preparation may be from about 0.5:1 to about 4:1, and for example from about 0.5:1 to about 2:1, although the relative amounts can be outside of these ranges.

Examples of suitable nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenc as IGEPAL CA-210®, IGEPAL CA-520®IGEPAL CA-720®, IGEPAL CO-890®, IGEPAL CO-720®, IGEPAL CO-290®, ANTAROX 890®, and ANTAROX 897®), and the like, as well as mixtures thereof. The nonionic surfactant can be present in any desired or effective amount, for example, from about 0.01% to about 10% by weight of monomers used to prepare the copolymer resin, and as a further example, from about 0.1% to about 5%, although the amount can be outside of these ranges.

Emulsion aggregation processes suitable for making the disclosed toner particles are illustrated in a number of patents, the disclosures of which are totally incorporated herein by reference, such as U.S. Pat. Nos. 5,278,020; 5,290,654; 5,308,734; 5,344,738; 5,346,797; 5,348,832; 5,364,729; 5,366,841; 5,370,963; 5,376,172; 5,403,693; 5,418,108; 5,405,728; 5,482,812; 5,496,676; 5,501,935; 5,527,658; 5,585,215; 5,593,807; 5,604,076; 5,622,806; 5,648,193; 5,650,255; 5,650,256; 5,658,704; 5,660,965; 5,723,253; 5,744,520; 5,763,133; 5,766,818; 5,747,215; 5,804,349; 5,827,633; 5,853,944; 5,840,462; 5,863,698; 5,869,215; 5,902,710; 5,910,387; 5,916,725; 5,919,595; 5,922,501; 5,925,488; 5,945,245; 5,977,210; 6,017,671; 6,020,101; 6,045,240; 6,132,924; 6,143,457; and 6,210,853. The components and processes of the patents can be selected for the present development and embodiments thereof.

Any suitable conventional electrophotographic development technique can be utilized to deposit the disclosed toner composition on an electrostatic latent image on an imaging member. Well known electrophotographic development techniques include magnetic brush development, cascade development, powder cloud development, electrophoretic development, and the like. Magnetic brush development is more fully described in, for example, U.S. Pat. No. 2,791,949, the disclosure of which is incorporated by reference herein. Cascade development is more fully described in, for example, U.S. Pat. Nos. 2,618,551 and 2,618,552, the disclosures of which are incorporated by reference herein. Powder cloud development is more fully described in, for example, U.S. Pat. Nos. 2,725,305; 2,918,910, and 3,015,305, the disclosures of which are incorporated by reference herein.

The deposited toner image can be transferred to a receiving member such as paper or transparency material by any suitable technique conventionally used in electrophotography, such as corona transfer, pressure transfer, adhesive transfer, bias roll transfer, and the like. After transfer, the transferred toner image can be fixed to a receiving sheet. The fixing step can also be identical to that conventionally used in electrophotographic imaging. Well known electrographic fusing techniques include heated roll fusing, flash fusing, oven fusing, laminating, adhesive spray fixing, and the like.

The toner compositions may be used to create images on a substrate using, for example, the processes described above. Once the image is formed, it may be fused by, for example, one of processes described above. The fused images may then be exposed to a curing system, such as an electron beam, microwave, ultra violet light, gamma ray, or x-ray curing system. For example, an electron beam curing system, such as a CB-175 Electrocure Electron Beam curing system, is available from Energy Sciences. The electron beam curing system may produce radiation at a temperature ranging from about 5° C. to about 30° C., at a dose ranging from about 0.2 to about 10 Mrads, and at a dose rate ranging from about 40 to about 150 Mrads/sec. Moreover, the electron beam radiation may have a cure rate ranging from about 10 to about 300 fpm, may have an accelerating potential ranging from about 150 to about 300 kV, and may have a residence time ranging from about 2 to about 100 seconds. The electron beam radiation may cure the toner.

The disclosed toner compositions can be applied on a wide array of substrates. For example, the substrate may be paper, cardboard, plastic, foil, metal, and combinations thereof.

EXAMPLE

The following example is illustrative and is non-limiting to the present teachings.

Polyner Latex Synthesis

Latex Example (I)

Poly(styrene-butyl acrylate-β-carboxyethyl acrylate) Polymer Latex

A polymer latex (EP501) comprised of a styrene/n-butyl acrylate/β-carboxyethyl acrylate copolymer of 74:23:3 prepared with 1.7 pph dodecanethiol (chain transfer agent), 0.35 pph branching agent (A-DOD, decanediol diacrylate, available from Shin-Najamura Co., Japan) and 1.5 percent of ammonium persulfate initiator was synthesized by a semicontinuous emulsion polymerization process using the anionic surfactant DOWFAX 2A1™ (sodium tetrapropyl diphenoxide disulfonate, 47 percent active, available from Dow Chemical).

In a 3 gallon jacketed stainless steel reactor with double flight impellers (a four pitched-blade impeller each) set at 35 rpm, 3.87 kilograms of deionized water with 5.21 grams of DOWFAX 2A1™ (7 percent of the total surfactant) were charged while the temperature was raised from room, about 23 to about 25° C., to 75° C. A monomer emulsion was prepared by mixing a monomer mixture (3108 grams of styrene, 966 grams of n-butyl acrylate, 122 grams of 2-carboxyethyl acrylate (β-CEA)), 14.3 grams of A-DOD and 45 grams of 1-dodecanethiol with 1930 grams of deionized water and 80.7 grams of DOWFAX 2A1™ (93 percent of the total surfactant) at room temperature for 30 minutes in a 1.5 gallon Pope tank. 63 grams of the seed were pumped from the monomer emulsion into a 0.2 gallon beaker and subsequently the seed was charged into the reactor at 75° C. An initiator solution prepared from 61 grams of ammonium persulfate in 302 grams of deionized water was added over 20 minutes after the seed emulsion addition. The reactor was stirred at 48 rpm for an additional 20 minutes to allow seed particle formation at 75° C. The monomer emulsion was then fed into the reactor. Monomer emulsion feeding was stopped after 110 minutes and 24.9 grams of 1-dodecanethiol (DDT) were added to the remaining emulsion in the 1.5 gallon Pope tank which was mixed for a further 5 minutes before feeding resumed. The remaining monomer emulsion was fed into the reactor over 90 minutes. At the end of the monomer feed, the emulsion was post-heated at 75° C. for 180 minutes, then cooled to 25° C. The reaction system was deoxygenated by passing a stream of nitrogen through it during the reaction. A latex resin containing 42 weight percent styrene-butyl acrylate-β-carboxyethyl acrylate resin, 57 weight percent water, 0.4 weight percent anionic surfactant DOWFAX 2A1™, 0.6 percent of an ammonium sulfate salt species was obtained. The resulting amorphous polymer poly(styrene-butyl acrylate-acrylic acid-β-carboxyethyl acrylate) possessed a weight-average molecular weight $M_w$ of 33,200, and a number-average molecular weight $M_n$ of 10,400, as determined on a Waters GPC, and a mid-point Tg of 50.7° C., as measured on a Seiko DSC. The latex resin or polymer possessed a volume average diameter of 222 nanometers as measured by light scattering technique on a Coulter N4 Plus Particle Sizer.

Latex Example (II)

Poly(styrene-butyl methacrylate-β-carboxyethyl acrylate) Polymer Latex

A polymer latex (EP502) comprised of a styrene/n-butyl methacrylate/β-carboxyethyl acrylate copolymer of 74:23:3 prepared with 1.7 pph dodecanethiol (chain transfer agent), 0.35 pph branching agent (A-DOD, decanediol diacrylate, available from Shin-Najamura Co., Japan) and 1.5 percent of ammonium persulfate initiator was synthesized by a semicontinuous emulsion polymerization process using the anionic surfactant DOWFAX 2A1™ (sodium tetrapropyl diphenoxide disulfonate, 47 percent active, available from Dow Chemical).

In a 3 gallon jacketed stainless steel reactor with double flight impellers (a four pitched-blade impeller each) set at 35 rpm, 3.87 kilograms of deionized water with 5.21 grams of DOWFAX 2A1™ (7 percent of the total surfactant) were charged while the temperature was raised from room, about 23 to about 25° C. to 75° C. A monomer emulsion was prepared by mixing a monomer mixture (3108 grams of styrene, 966 grams of n-butyl methacrylate, 122 grams of 2-carboxyethyl acrylate), 14.3 grams of A-DOD and 45 grams of 1-dodecanethiol with 1930 grams of deionized water and 80.7 grams of DOWFAX 2A1™ (93 percent of the total surfactant) at room temperature for 30 minutes in a 1.5 gallon Pope tank. 63 grams of the seed were pumped from the monomer emulsion into a 0.2 gallon beaker and subsequently the seed was charged into the reactor at 75° C. An initiator solution prepared from 61 grams of ammonium persulfate in 302 grams of deionized water was added over 20 minutes after the seed emulsion addition. The reactor was stirred at 48 rpm for an additional 20 minutes to allow seed particle formation at 75° C. The monomer emulsion was then fed into the reactor. Monomer emulsion feeding was stopped after 110 minutes and 24.9 grams of 1-dodecanethiol (DDT) were added to the remaining emulsion in the 1.5 gallon Pope tank which was mixed for a further 5 minutes before feeding resumed. The remaining monomer emulsion was fed into the reactor over 90 minutes. At the end of the monomer feed, the emulsion was post-heated at 75° C. for 180 minutes, then cooled to 25° C. The reaction system was deoxygenated by passing a stream of nitrogen through it during the reaction. A latex resin containing 42 weight percent styrene-butyl methacrylate-β-carboxyethyl acrylate resin, 57 weight percent water, 0.4 weight percent anionic surfactant DOWFAX 2A1™, 0.6 percent of an ammonium sulfate salt species was obtained. The resulting amorphous polymer poly(styrene-butyl methacrylate-β-carboxyethyl acrylate) possessed a weight-average molecular weight $M_w$ of 53,800, and a number-average molecular weight $M_n$ of 16,700, as determined on a Waters GPC, and a mid-point Tg of 59.2° C., as measured on a Seiko DSC. The latex resin or polymer possessed a volume average diameter of 241 nanometers as measured by light scattering technique on a Coulter N4 Plus Particle Sizer.

Comparative Latex Example (I)

Poly(styrene-butyl acrylate-acrylic acid) Polymer Latex

A polymer latex (EP515) comprised of a styrene/n-butyl acrylate/acrylic acid copolymer of 74:23:3 prepared with 1.7 pph dodecanethiol (chain transfer agent), 0.35 pph branching agent (A-DOD, decanediol diacrylate, available from Shin-Najamura Co., Japan) and 1.5 percent of ammonium persulfate initiator was synthesized by a semicontinuous emulsion polymerization process using the anionic surfactant DOWFAX 2A1™ (sodium tetrapropyl diphenoxide disulfonate, 47 percent active, available from Dow Chemical).

In a 3 gallon jacketed stainless steel reactor with double flight impellers (a four pitched-blade impeller each) set at 35 rpm, 3.87 kilograms of deionized water with 5.21 grams of DOWFAX 2A1™ (7 percent of the total surfactant) were charged while the temperature was raised from room, about 23 to about 25° C. to 75° C. A monomer emulsion was prepared by mixing a monomer mixture (3108 grams of styrene, 966 grams of n-butyl acrylate, 122 grams of acrylic acid), 14.3 grams of A-DOD and 45 grams of 1-dodecanethiol with 1930 grams of deionized water and 80.7 grams of DOWFAX 2A1™ (93 percent of the total surfactant) at room temperature for 30 minutes in a 1.5 gallon Pope tank. 63 grams of the seed were pumped from the monomer emulsion into a 0.2 gallon beaker and subsequently the seed was charged into the reactor at 75° C. An initiator solution prepared from 61 grams of ammonium persulfate in 302 grams of deionized water was added over 20 minutes after the seed emulsion addition. The reactor was stirred at 48 rpm for an additional 20 minutes to allow seed particle formation at 75° C. The monomer emulsion was then fed into the reactor. Monomer emulsion feeding was stopped after 110 minutes and 24.9 grams of 1-dodecanethiol (DDT) were added to the remaining emulsion in the 1.5 gallon Pope tank which was mixed for a further 5 minutes before feeding resumed. The remaining monomer emulsion was fed into the reactor over 90 minutes. At the end of the monomer feed, the emulsion was post-heated at 75° C. for 180 minutes, then cooled to 25° C. The reaction system was deoxygenated by passing a stream of nitrogen through it during the reaction. A latex resin containing 42 weight percent styrene-butyl acrylate-acrylic acid resin, 57 weight percent water, 0.4 weight percent anionic surfactant DOWFAX 2A1™, 0.6 percent of an ammonium sulfate salt species was obtained. The resulting amorphous polymer poly(styrene-butyl acrylate-acrylic acid) possessed a weight-average molecular weight $M_w$ of 36,800, and a number-average molecular weight $M_n$ of 11,200, as determined on a Waters GPC, and a mid-point Tg of 53.1° C., as measured on a Seiko DSC. The latex resin or polymer possessed a volume average diameter of 219 nanometers as measured by light scattering technique on a Coulter N4 Plus Particle Sizer.

Toner Particle Preparation:

Example I 5.6 Micron Yellow Toner Particles Generated by PAC Aggregation/Coalescence Process The poly(styrene-butyl acrylate-β-carboxyethyl acrylate) polymer latex of Latex Example (I) (EP501) above was utilized in an aggregation/coalescence (A/C) process to produce 5.6 micron (volume average diameter) particles with a narrow size distribution.

500 grams of deionized water was placed in a stainless steel beaker and homogenized at 5,000 rpm, while there was added 300 grams of latex poly(styrene-butyl acrylate-β-carboxyethyl acrylate) (EP501), 37.16 grams of the polyethylene wax POLYWAX 725® dispersion (Mw of 725, 31 percent active, available from Baker-Petrolite Company) followed by the addition of 38.3 grams of PY74 yellow pigment dispersion (17 percent active, available from Sun Chemicals) diluted with 110 grams of deionized water. To the resulting homogenized latex/pigment blend, 2.4 grams of 10 percent PAC (polyaluminum chloride obtained from Asada Company of Japan) solution diluted with 24 grams of 0.02N $HNO_3$ was added dropwise to cause a flocculation of the PY74 yellow pigment, 6 percent by weight, the POLYWAX 725®, 9 percent by weight, the resin, 84.88 weight percent, and 0.12 weight percent of the PAC. After the addition was complete, homogenization was continued for an additional 2 minutes to form a creamy blend with an average particle size by volume of 2.63 and with a GSDv of 1.20. The creamy blend was then transferred into a 2 liter glass reactor and stirred at 350 rpm, while being heated to about 52° C. to about 53° C. Particle growth was monitored during heating. When the particle size diameter of the solids by volume was equal to 5.54 (GSDv=1.21), the pH of the slurry was adjusted. The slurry was comprised of about 16 weight percent of toner and of about 84 weight percent of water. The toner was comprised of about 6 percent of PY74 yellow pigment, about 9 percent of POLYWAX 725®, about 0.2 weight percent of PAC and about 84.8 percent by weight of the resin poly(styrene-butyl acrylate-β-carboxyethyl acrylate). The total amount of the toner components was about 100 percent. The pH was adjusted to 7.5 by the addition of a 2 percent NaOH solution and the speed in the reactor was reduced to 200 rpm. After ½ hour of stirring at 53° C., the temperature in the reactor was increased to 95° C. After 1 hour of heating at 95° C., the pH of the slurry was adjusted to 4.3 and the heating was continued for an additional 5 hours. Thereafter, the reactor contents were cooled down to about room temperature, throughout the Examples, about 23° C. to about 25° C. and were discharged. A 16 percent solids slurry of 5.64 micron black toner particles with GSDv=1.21 was obtained. The resulting toner product was comprised of about 6 percent of PY74 yellow pigment, about 9 percent of POLYWAX 725®, about 0.2 weight percent of PAC and about 84.8 percent by weight of the resin poly(styrene-butyl acrylate-β-carboxyethyl acrylate), and wherein the total amount of the toner components was about 100 percent. The toner particles were then washed with deionized water five times and dried.

Example II 5.6 Micron Yellow Toner Particles Generated by PAC Aggregation/Coalescence Process The poly(styrene-butyl acrylate-β-carboxyethyl methacrylate) polymer latex of Latex Example (II) (EP502) above was utilized in an aggregation/coalescence (A/C) process to produce 5.6 micron (volume average diameter) particles with a narrow size distribution.

500 grams of deionized water was placed in a stainless steel beaker and homogenized at 5,000 rpm, while there was added 300 grams of latex poly(styrene-butyl methacrylate-β-carboxyethyl acrylate) (EP502), 37.16 grams of the polyethylene wax POLYWAX 725® dispersion (Mw of 725, 31 percent active, available from Baker-Petrolite Company) followed by the addition of 38.3 grams of PY74 yellow pigment dispersion (17 percent active, available from Sun Chemicals) diluted with 110 grams of deionized water. To the resulting homogenized latex/pigment blend, 2.4 grams of 10 percent PAC (polyaluminum chloride obtained from Asada Company of Japan) solution diluted with 24 grams of 0.02N $HNO_3$ was added dropwise to cause a flocculation of the PY74 yellow pigment, 6 percent by weight, the POLYWAX 725®, 9 percent by weight, the resin, 84.88 weight percent, and 0.12 weight percent of the PAC. After the addition was complete, homogenization was continued for an additional 2 minutes to form a creamy blend with an average particle size by volume of 2.68 and with a GSDv of 1.21. The creamy blend was then transferred into a 2 liter glass reactor and stirred at 350 rpm, while being heated to about 52° C. to about 53° C. Particle growth was monitored during heating. When the particle size diameter of the solids by volume was equal to 5.44 (GSDv=1.20), the pH of the slurry was adjusted. The slurry was comprised of about 16 weight percent of toner and of about 84 weight percent of water. The toner was comprised of about 6 percent of PY74 yellow pigment, about 9 percent of POLYWAX 725®, about 0.2 weight percent of PAC and about 84.8 percent by weight of the resin poly(styrene-butyl methacrylate-β-carboxyethyl acrylate). The total amount of the toner components was about 100 percent. The pH was adjusted to 7.5 by the addition of a 2 percent NaOH solution and the speed in the reactor was reduced to 200 rpm. After ½ hour of stirring at 53° C., the temperature in the reactor was increased to 95° C. After 1 hour of heating at 95° C., the pH of the slurry was adjusted to 4.3 and the heating was continued for an additional 5 hours. Thereafter, the reactor contents were cooled down to about room temperature, throughout the Examples, about 23° C. to about 25° C. and were discharged. A 16 percent solids slurry of 5.62 micron black toner particles with GSDv=1.19 was obtained. The resulting toner product was comprised of about 6 percent of PY74 yellow pigment, about 9 percent of POLYWAX 725®, about 0.2 weight percent of PAC and about 84.8 percent by weight of the resin poly(styrene-butyl methacrylate-β-carboxyethyl acrylate), and wherein the total amount of the toner components was about 100 percent. The toner particles were then washed with deionized water five times and dried.

Example III 5.7 Micron Yellow Toner Particles Generated by a Conventional Process A polyester toner containing β-carboxyethyl acrylate was prepared by melt mixing in the extrusion device Haake Rheomix TYPE 557-1302 obtained from Polylab System, 260 grams of a polyester resin that was comprised of 63.7 parts by weight of 4,4'-hydroxy ethoxy bisphenol A terephthalate, 17 parts by weight of 1,4-cyclohexane dimethanol terephthalate, 4.3 parts by weight of β-carboxyethyl acrylate, 6 parts by weight of PY74 yellow pigment (available from Sun Chemicals), and 9 parts by weight of POLYWAX 725® (Mw of 725, available from Baker-Petrolite Company). The product was heated at 120° C. for 20 minutes in the above mixer with the rpm speed at 100. Subsequently, the resulting polyester toner extruded resin was subjected to grinding in a micronizer (Sturtevant Mill Company, Boston, Mass.) enabling polyester particles with a volume median diameter of 5.72 microns with GSDv=1.35 was obtained. The resulting toner product was comprised of about 6 percent of PY74 yellow pigment, about 9 percent of POLYWAX 725®, and about 85 percent by weight of the β-carboxyethyl acrylate containing polyester resin.

Comparative Example I 5.6 Micron Yellow Toner Particles Generated by PAC Aggregation/Coalescence Process The poly(styrene-butyl acrylate-acrylic acid) polymer latex of Comparative Latex Example (I) (EP515) above was utilized in an aggregation/coalescence (A/C) process to produce 5.6 micron (volume average diameter) particles with a narrow size distribution.

500 grams of deionized water was placed in a stainless steel beaker and homogenized at 5,000 rpm, while there was added 300 grams of latex poly(styrene-butyl acrylate-acrylic acid) (EP515), 37.16 grams of the polyethylene wax POLYWAX 725® dispersion (Mw of 725, 31 percent active, available from Baker-Petrolite Company) followed by the addition of 38.3 grams of PY74 yellow pigment dispersion (17 percent active, available from Sun Chemicals) diluted with 110 grams of deionized water. To the resulting homogenized latex/pigment blend, 2.4 grams of 10 percent PAC (polyaluminum chloride obtained from Asada Company of Japan) solution diluted with 24 grams of 0.02N $HNO_3$ was added dropwise to cause a flocculation of the PY74 yellow pigment, 6 percent by weight, the POLYWAX 725®, 9 percent by weight, the resin, 84.88 weight percent, and 0.12 weight percent of the PAC. After the addition was complete, homogenization was continued for an additional 2 minutes to form a creamy blend with an average particle size by volume of 2.68 and with a GSDv of 1.21. The creamy blend was then transferred into a 2 liter glass reactor and stirred at 350 rpm, while being heated to about 52° C. to about 53° C. Particle growth was monitored during heating. When the particle size diameter of the solids by volume was equal to 4.84 (GSDv=1.21), the pH of the slurry was adjusted. The slurry was comprised of about 16 weight percent of toner and of about 84 weight percent of water. The toner was comprised of about 6 percent of PY74 yellow pigment, about 9 percent of POLYWAX 725®, about 0.2 weight percent of PAC and about 84.8 percent by weight of the resin poly(styrene-butyl acrylate-acrylic acid). The total amount of the toner components was about 100 percent. The pH was adjusted to 7.5 by the addition of a 2 percent NaOH solution and the speed in the reactor was reduced to 200 rpm. After ½ hour of stirring at 53° C., the temperature in the reactor was increased to 95° C. After 1 hour of heating at 95° C., the pH of the slurry was adjusted to 4.3 and the heating was continued for an additional 5 hours. Thereafter, the reactor contents were cooled down to about room temperature, throughout the Examples, about 23° C. to about 25° C. and were discharged. A 16 percent solids slurry of 5.65 micron black toner particles with GSDv=1.22 was obtained. The resulting toner product was comprised of about 6 percent of PY74 yellow pigment, about 9 percent of POLYWAX 725®, about 0.2 weight percent of PAC and about 84.8 percent by weight of the resin poly(styrene-butyl acrylate-acrylic acid), and wherein the total amount of the toner components was about 100 percent. The toner particles were then washed with deionized water five times and dried.

Evaluation:

Yellow toners of the above Examples I to III and Comparative Example I were evaluated by forming images in a MajectiK 5765 copier in both Xerox 4024 paper and Xerox 3R3108 transparency, and fusing the images using Imari-MF free belt nip fuser. After the fusing step, the yellow toner images of Examples I to III and Comparative Example I demonstrated poor rub resistance. All the images were smeared after 10 double rubs with toluene laden cloth.

Yellow toners of the above Examples I to III and Comparative Example I were evaluated by forming images in a MajectiK 5765 copier in both Xerox 4024 paper and Xerox 3R3108 transparency, and fusing the images using Imari-MF free belt nip fuser. After the fusing step, these yellow toner images were exposed to a CB-175 Electrocure Electron Beam curing system (available from Energy Sciences), with an accelerating potential of 175 kV. The exposure time (residence time) is set at about 1 minute. The electron beam dose was set about 5 Mrads, with a dose rate of 100 Mrads/sec. The radiation temperature was maintained between 25 to 30° C. The post-cured yellow toner images of Examples I to III demonstrated excellent rub resistance. The images resisted 20 double rubs with toluene-damped cloth. In contrast, the yellow toner images of Comparative Example I demonstrated poor rub resistance. The yellow toner images of Comparative Example I were smeared after 5 double rubs with toluene-damped cloth.

Images on polymer substrates and packaging cardboard were performed on bench development setup and fusing fixture. The above-mentioned developer made for MajectiK 5765 copier was incorporated into an electrostatographic imaging device with a cascade development zone. The substrates used for the development were brown paper cardboard and a few different polymer substrates such as polyethylene terephthalate (PET), high-density polyethylene (HDPE), polypropylene (PP), and NYLON®. After about 1.4 gm/cm$^2$ solid density was developed, the substrate and the toner were fused using a silicone rubber fuser roll from a Xerox 5028 machine. The surface temperature of the fuser roll was set at about 400° F. and the speed was set at about 120 rpm. After the fusing step, these yellow toner images were exposed to a CB-175 Electrocure Electron Beam curing system and the rubbing tests were performed as mentioned above. All images made from toner in Examples I to III on polymer substrates and packaging cardboards resisted 20 double rubs with toluene-damped cloth, which showed improvement in solvent resistance after electron beam curing compared to non-electron beam curable toner images made from Comparative Example I. Polyethylene and polypropylene films showed equivalent development as PET films as the substrates. PE and PP films are excellent substrates for toner fused below 120° C.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a range of "less than 10" includes any and all subranges between (and including) the minimum value of zero and the maximum value of 10, that is, any and all subranges having a minimum value of equal to or greater than zero and a maximum value of equal to or less than 10, e.g., 1 to 5.

It is noted that, as used in this specification and the appended claims, the singular forms "a," "an," and "the," include plural referents unless expressly and unequivocally limited to one referent. Thus, for example, reference to "at least one resin" includes two or more different resins. As used herein, the term "include" and its grammatical variants are intended to be non-limiting, such that recitation of items in a list is not to the exclusion of other like items that can be substituted or added to the listed items.

It will be apparent to those skilled in the art that various modifications and variations can be made to various embodiments described herein without departing from the spirit or scope of the present teachings. Thus, it is intended that the various embodiments described herein cover other modifications and variations within the scope of the appended claims and their equivalents.

What is claimed is:

1. A process comprising radiating toner with electron beam radiation, wherein the toner comprises at least one resin and at least one colorant, and wherein the toner is generated by an emulsion aggregation coalescence method;

wherein the radiation results in curing the toner, and wherein the electron beam radiation is produced by an electron beam curing system.

2. The process of claim 1, further comprising a step of forming an image with the toner on a substrate and fusing the toner formed image to the substrate prior to the step of radiating.

3. The process of claim 1, wherein the electron beam radiation is applied at a temperature ranging from about 5° C. to about 30° C., at a dose ranging from about 0.2 to about 10 Mrads, and at a dose rate ranging from about 40 to about 150 Mrads/sec.

4. The process of claim 1, wherein the electron beam radiation has a cure rate ranging from about 10 to about 300 fpm, has an accelerating potential ranging from about 150 to about 300 kV, and has a residence time ranging from about 2 to about 100 seconds.

5. The process of claim 1, wherein the at least one resin is selected from the group consisting of a styrene-based resin, a polyester-based resin, and a polymeric esterification product of a dicarboxylic acid and a diol comprising a diphenol.

6. The process of claim 1, wherein the resin comprises at least one vinyl monomer and at least one electron beam curable polymer.

7. The process of claim 6, wherein the at least one vinyl monomer is selected from the group consisting of styrene, substituted styrene, 1,3-dienes, substituted 1,3-dienes, acrylates, methacrylates, acrylonitrile, acrylic acid, and methacrylic acid.

8. The process of claim 1, wherein the at least one resin is selected from the group consisting of poly(styrene-butadiene-β-carboxyethyl acrylate), poly(methylstyrene-butadiene-β-carboxyethyl acrylate), poly(methyl methacrylate-β-carboxyethyl acrylate), poly(ethyl methacrylate-butadiene-β-carboxyethyl acrylate), poly(propyl methacrylate-butadiene-β-carboxyethyl acrylate), poly(butyl methacrylate-butadiene-β-carboxyethyl acrylate), poly(methyl acrylate-butadiene-β-carboxyethyl acrylate), poly(ethyl acrylate-β-carboxyethyl acrylate), poly(propyl acrylate-butadiene-β-carboxyethyl acrylate), poly(styrene-isoprene-β-carboxyethyl acrylate), poly(methylstyrene-isoprene-β-carboxyethyl acrylate), poly(methyl methacrylate-isoprene-β-carboxyethyl acrylate), poly(ethyl methacrylate-isoprene-β-carboxyethyl acrylate), poly(propyl methacrylate-isoprene-β-carboxyethyl acrylate), poly(butyl methacrylate-isoprene-β-carboxyethyl acrylate), poly(methyl acrylate-isoprene-β-carboxyethyl acrylate), poly(ethyl acrylate-isoprene-β-carboxyethyl acrylate), poly(propyl acrylate-isoprene-β-carboxyethyl acrylate), poly(styrene-propyl acrylate-β-carboxyethyl acrylate), poly(styrene-butyl acrylate-β-carboxyethyl acrylate), and poly(styrene-butyl acrylate-acrylonitrile-β-carboxyethyl acrylate).

9. The process of claim 6, wherein the at least one electron beam curable polymer is a mixture of dimeric acrylic acid and oligomeric acrylic acid.

10. The process of claim 9, wherein at least one of the dimeric acrylic acid and the oligomeric acrylic acid is an alkenoic acid.

11. The process of claim 10, wherein the alkenoic acid is an olefinically unsaturated carboxy functional monomer.

12. The process of claim 11, wherein the olefinically unsaturated carboxy functional monomer has the formula:

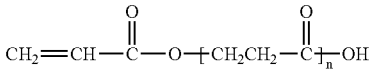

wherein n is an integer of from about 1 to about 20.

13. The process of claim 12, wherein n is an integer of from about 1 to about 13.

14. The process of claim 12, wherein n is an integer of from about 1 to about 5.

15. The process of claim 6, wherein the at least one electron beam curable polymer is present in the at least one resin in an amount ranging from about 10% to about 100% by weight with respect to the total weight of the resin.

16. The process of claim 15, wherein the at least one electron beam curable polymer is present in the at least one resin in an amount ranging from about 20% to about 40% by weight with respect to the total weight of the resin.

17. The process of claim 1, wherein the at least one resin comprises styrene, butyl acrylate, and 2-carboxyethyl acrylate.

18. The process of claim 1, wherein the toner is generated by a first and second heating of the at least one resin and at least one colorant;

wherein the first heating is at a temperature lower than the second heating temperature;

and wherein the first heating is below the glass transition temperature of the at least one resin.

19. A method for crosslinking toner particles comprising radiating toner particles formed by an emulsion aggregation process with electron beam radiation, wherein the toner particles comprise at least one resin with crosslinkable functional groups.

* * * * *